US010795281B2

(12) United States Patent
Li et al.

(10) Patent No.: US 10,795,281 B2
(45) Date of Patent: Oct. 6, 2020

(54) COMPENSATING VOLTAGES FOR ELECTROPHOTOGRAPHY PRINTING DEVICES

(71) Applicant: HP Indigo B.V., Amstelveen (NL)

(72) Inventors: Guang Jin Li, San Diego, CA (US); Eric G Nelson, Boise, ID (US); Ido Finkelman, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/605,507

(22) PCT Filed: Aug. 24, 2017

(86) PCT No.: PCT/US2017/048443
§ 371 (c)(1),
(2) Date: Oct. 16, 2019

(87) PCT Pub. No.: WO2019/040070
PCT Pub. Date: Feb. 28, 2019

(65) Prior Publication Data

US 2020/0125001 A1 Apr. 23, 2020

(51) Int. Cl.
*G03G 15/08* (2006.01)
*G03G 15/06* (2006.01)

(52) U.S. Cl.
CPC ..... *G03G 15/065* (2013.01); *G03G 15/0812* (2013.01)

(58) Field of Classification Search
CPC ..... G03G 15/065; G03G 15/11
USPC ..... 399/55, 240
See application file for complete search history.

(56) References Cited

U.S. PATENT DOCUMENTS

| | | | | |
|---|---|---|---|---|
| 5,471,292 | A | 11/1995 | Okazawa | |
| 7,024,126 | B2 | 4/2006 | Kellie et al. | |
| 8,401,409 | B2 | 3/2013 | Schleusener et al. | |
| 8,792,796 | B2 | 7/2014 | Kella et al. | |
| 9,244,390 | B2 | 1/2016 | Lam et al. | |
| 10,353,320 | B2 * | 7/2019 | Nelson et al. | G03G 15/11 |
| 2009/0016755 | A1 | 1/2009 | Kellie et al. | |
| 2011/0102003 | A1 | 5/2011 | Bhattacharyya | |
| 2016/0342122 | A1 | 11/2016 | Parvin et al. | |

FOREIGN PATENT DOCUMENTS

WO WO-2014021869 A1 2/2014

OTHER PUBLICATIONS

PhotoBox improves productivity thanks to the HP Indigo Customer Excellence Programme, Dec. 2014, Retrieved from URL: http://www8.hp.com/h20195/v2/GetPDF.aspx/4AA5-5599EEW.

* cited by examiner

*Primary Examiner* — William J Royer
(74) *Attorney, Agent, or Firm* — HP Inc. Patent Department

(57) ABSTRACT

A method of balancing current in a developer roller is described. The method includes pulsing voltage to a squeegee roller and a cleaner roller. The pulsed voltage yields a differential voltage at the developer roller after impression. The method also includes pulsing compensating voltage to at least one of the squeegee roller or the cleaner roller to reduce or cancel an accumulated developer current imbalance of the developer roller. The compensating voltage pulses include pulses before or after the impression.

15 Claims, 9 Drawing Sheets

(a)

(b)

COMPENSATING VOLTAGES FOR ELECTROPHOTOGRAPHY PRINTING DEVICES

BACKGROUND

Images and text may be formed on a substrate using a photoconductive element. Print substances may be transferred to and from the photoconductive element using charged surfaces and/or rollers and/or by forming electric fields between surfaces and/or rollers. Such methods may be referred to as electrophotography. Among the types of electrophotography, liquid print substance-based electrophotography may allow formation of images and/or text using conductive elements (e.g., metals or metalloids).

BRIEF DESCRIPTION OF THE DRAWINGS

Various examples will be described below by referring to the following figures.

Figure 1:
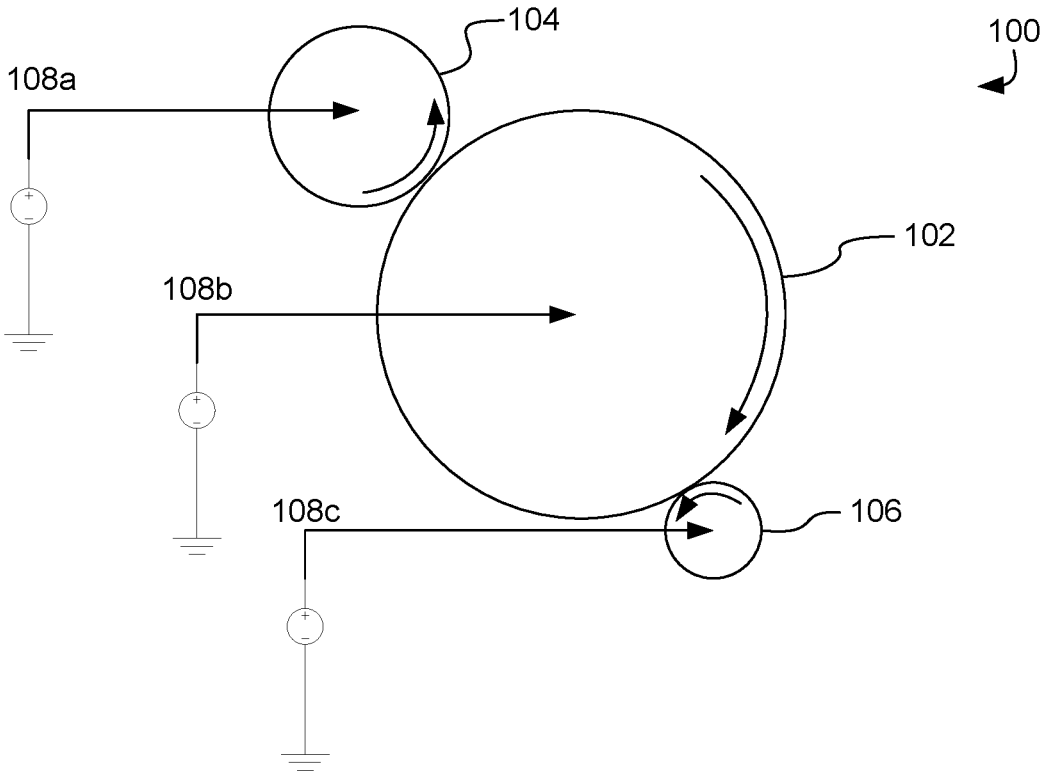
FIG. 1 is a schematic diagram of an example electrophotographic device.

Reference is made in the following detailed description to accompanying drawings, which form a part hereof, wherein like numerals may designate like parts throughout that are corresponding and/or analogous. It will be appreciated that the figures have not necessarily been drawn to scale, such as for simplicity and/or clarity of illustration.

DETAILED DESCRIPTION

A number of methods exist for forming an image on a substrate, such as a web or a sheet of paper. The act of forming an image or text on a substrate is referred to herein as impression. By way of example, one method of impression comprises electrophotography (EP), which refers to a method of forming an image on a substrate using a photoconductor and selectively charged surfaces and/or voltage potentials. In some examples, print substances may be transferred sequentially from a reservoir to a developer roller, a photoconductor drum, and a substrate. Certain examples may include a transfer of print substances from a photoconductor drum to an intermediate transfer member, and from an intermediate transfer member to the substrate. The print substances may subsequently be adhered to the substrate (e.g., such as by application of heat and/or pressure). One form of EP uses a dry print substance, referred to at times as toner. Another form of EP uses a liquid substance to form an image on a substrate (e.g., liquid EP or LEP). The liquid print substance is referred to herein as print fluid, and comprises a combination of liquid and solids. In one case, the liquids may be reduced (e.g., removed, evaporated, etc.) and the solids may be softened prior to adhering to a substrate.

In one example case, an example print fluid may comprise approximately 98% liquid and approximately 2% solids when stored in a reservoir. The solids may be charged (e.g., negatively). The liquid may include a liquid carrier (e.g., a solvent, an oil, etc.). For example, the liquid may include a dielectric oil comprising hydrocarbons of various weights. The solids may include a colorant, such as a number of pigments, a number of polymer resins, or the like. The liquid or solids may also include numerous additional compounds, such as charge active agents, stabilization compounds, or the like.

Depending on a particular implementation, an EP device capable of using a print fluid may comprise a number of transfer surfaces (e.g., drums or rollers) between a reservoir and a substrate. As used hereinafter, surfaces, rollers, and drums are referred to interchangeably as drums or rollers, without limitation, and are not intended to be taken in a limiting sense. In one such implementation, the process of impression includes transferring a print fluid having charged solids (e.g., negatively charged solids) from one transfer surface to the next until finally depositing the print fluid (e.g., softened solids of the print fluid) on the substrate. For instance, one such example process may comprise developing print fluid in a developer unit and selectively transferring the developed print fluid to a photoconductive drum (also referred to as a photo imaging plate or PIP) onto which a latent image has been fixed, such as by exposure to light (e.g., a negatively charged photoconductor may be selectively discharged by a laser or LED). The transfer of print fluid to the photoconductive drum may be referred to as a zero transfer. The photoconductive drum may transfer the print fluid representing the latent image to an intermediate transfer member (ITM), which may include a transfer blanket. The transfer of print fluid to the ITM may be referred to as a first transfer. At the ITM, the liquid portion of the print fluid may evaporate and remaining resin-based solids may soften. The ITM may transfer the solids to a surface of a substrate, which transfer may be referred to as a second transfer. A supporting impression drum may support the substrate and facilitate adhering the solids to the substrate, such as through the application of heat and/or pressure in combination with the ITM and the transfer blanket.

As part of an impression process, transferring print fluid from one surface to another may comprise setting different voltage potentials at different components of an EP device such that a differential voltage forms a field between components to cause print fluid (e.g., solids) to transfer from one surface to another (e.g., attracting negatively charged print fluid solids to a second surface having a voltage potential that is less negative than a voltage potential of the first surface). FIG. 1 is a schematic illustration of several example components of an EP device 100, which may comprise an LEP device. In one implementation, an EP device 100 may comprise a developer roller (DR) 102, a squeegee roller (SQ) 104, and a cleaner roller (CL) 106. Voltage pulses **108*a*-108*c* represent voltage potentials set at DR 102, SQ 104, and CL 106**.

Differential voltages between components of EP device 100 may enable transfer of print fluid (e.g., solids) from one surface to another. For example, a differential voltage between an electrode (not shown) in proximity to DR 102 and DR 102 may engender an electric field between the electrode and DR 102. The field may cause print fluid (e.g., solids) to move toward DR 102, such as from a reservoir or similar component. For instance, in one example case involving print fluid with negatively charged solids, a large negative voltage may be set at the electrode and DR 102 may have a less negative voltage potential. Thus, the charged solids of the print fluid may be attracted to DR 102. Of course, implementations with positively charged solids may work analogously.

Returning to FIG. 1, DR 102 is capable of rotating about a central axis, as illustrated by the arrow indicating clockwise rotation (of course, this direction of rotation, and those discussed hereinafter, is provided by way of example and is not to be taken in a limiting sense). As DR 102 rotates, transferred print fluid (e.g., comprising a combination of solids, such as ink, and liquid carrier) may coat an exterior surface of DR 102. In one case, the print fluid coating the exterior surface of DR 102 may have a different concentration of solids and/or liquid carrier than the print fluid stored in a reservoir (e.g., the print fluid solids may be more concentrated). SQ 104 may be arranged in proximity to DR 102 and may be capable of removing excess liquid carrier from the surface of DR 102 and thus further concentrating print fluid solids on the surface of DR 102 (e.g., in response to a voltage potential set at SQ 104), by way of non-limiting example. SQ 104 may also rotate about a central axis, such as illustrated by the counterclockwise arrow. A combination of pressure from SQ 104 and a field formed between SQ 104 and DR 102 (e.g., in response to voltage pulses 108*a* and 108*b*) may concentrate print fluid solids on DR 102 and remove excess print fluid liquids (e.g., liquid carrier).

EP device 100 also includes CL 106, which also rotates about a central axis as illustrated by the counterclockwise arrow of CL 106. CL 106 is arranged relative to DR 102 to remove residual print fluid (e.g., solids and liquid carrier not transferred to a photoconductor) from the surface of DR 102. Removal of residual print fluid may occur in response to voltage pulses 108*b* and 108*c* (e.g., voltage potential) at CL 106 sufficient to engender a field between DR 102 and CL 106. Voltage pulses 108*b* and 108*c* may be selected to remove print fluid remaining on DR 102. The removal of residual print fluid by CL 106 may occur after transfer of print fluid from DR 102 to a photoconductive drum, as shall be discussed in greater detail hereinafter.

A photoconductive drum (not shown in FIG. 1, see FIG. 2) may attract print fluid in response to a voltage differential between the photoconductive drum and DR 102. The photoconductive drum may be charged and exposed to light from a light source (e.g., a laser, an LED, etc.) to selectively discharge portions of a surface of the photoconductive drum and to form a latent image on its surface. The latent image may be formed of a combination of charges (e.g., negatively charged portions and discharged portions in one case, positively charged portions and discharged portions in another case, etc.) that selectively attract print fluid from DR 102. Print fluid on the photoconductive drum corresponding to the latent image may then be transferred to a substrate, to which the print fluid (e.g., comprising concentrated solids) may be subsequently adhered, such as by using heat and/or pressure.

In one implementation, an EP device 100 may comprise a plurality of developer units, each comprising a developer roller-squeegee roller-cleaner roller combination. For example, an example EP device 100 may comprise a developer unit for yellow, a developer unit for magenta, a developer unit for cyan, and a developer unit for black print fluids, respectively. Additionally, at times, developer units may be desired for "metallic" print fluids. For instance, it may be desirable to form images having a metallic aspect, such as appearing to comprise a metal, such as resembling silver or gold, by way of non-limiting example. In one case, for example, a silver print fluid may comprise flakes of aluminum (Al) as part of the solids contained in the print fluid. Of note, however, as opposed to typical YMCK print fluids (which may comprise largely non-conductive particles, such as non-conductive pigments and/or resins), metallic print fluids may be "conductive" due to the presence of metallic particles in the print fluid. Consequently, developer units (e.g., developer rollers, squeegee rollers, cleaner rollers, etc.) for metallic print fluids may comprise structural and/or functional differences as compared with developer units for traditional non-metallic print fluids. For example, a developer roller for metallic print fluids may have a structure and materials to attract print fluids comprising conductive solids (e.g., an outer layer different from that of developer rollers for non-conductive print fluids).

For example, in one implementation, developer rollers (e.g., YMCK and silver) may have a conductive rubber layer several millimeters thick. Conductivity of the rubber layer may come from an ionic conductor in the rubber layer. For developer rollers for conductive print fluid (e.g., silver or aluminum), it may be desirable to have an outer rubber layer that is less conductive than, for example, an outer rubber layer of YMCK developer rollers. Thus, in one case, a developer unit for conductive print fluid may comprise a first layer (e.g., rubber) having an ionic conductor and a second layer on the first layer that is less conductive than the first layer (e.g., achieved by not having an ionic conductor in the second layer). However, in the case of the developer unit for conductive print fluids, currents in the developer roller can cause migration of ionic conductor, such as to cause conductivity imbalance. The conductive print fluid (e.g., comprising concentrated solids) may be subsequently transferred to a transfer member and on to a substrate. As discussed above, transfer of print fluid (e.g., conductive print fluid) to a developer roller, a photoconductive drum, an intermediate transfer member, and to a substrate may be accomplished responsive to fields formed between the respective components of the EP device. However, at times, net currents in a developer roller may accumulate over a period of time (e.g., an impression cycle) and may be undesirable. For instance, if over a period of time (e.g., one or more impression cycles), positive and negative currents do not cancel out, a net negative or positive current on the developer roller (e.g., accumulated current imbalance) may lead to a reduced ability to transfer conductive print fluids, as shall be described hereinafter. There may therefore be a desire to avoid accumulated current imbalances over a period of time at a developer roller.

In addition to desiring to avoid accumulated developer current imbalances, there may be a desire to remove residual print fluid on DR 102. For example, an electric field may form between CL 106 and DR 102 (such as in response to a differential voltage) to enable removal of residual print fluid from DR 102. At times, due, for example, to a particular formed field, CL 106 may not completely remove residual print fluid from the developer roller. Thus, in subsequent impression cycles a surface of a developer roller may retain print fluid. The presence of residual print fluid on the developer roller, such as DR 102, may lead to residual print fluid being transferred to a substrate in subsequent impression cycles. This may be referred to as image memory. The term image memory refers residual print fluid on the developer roller that is not removed by CL 106 and that may be transferred to a substrate. One method for avoiding or reducing image memory may include setting a voltage potential at CL 106 (e.g., voltage pulse 108*c*), sufficient to cause a differential large enough to remove residual print fluid (e.g., but not so large that excess charge is deposited on CL 106).

The combination of differential voltage values between DR 102 and various components of EP device 100 may yield a developer current at DR 102. Over a period of time, an unbalanced developer current may accumulate at DR 102 and may be undesirable in some cases, such as for developer units for conductive print fluids. As used herein, accumulated developer current imbalance refer to a net positive or negative current value over a time period (e.g., summing or integrating current over a period of time, where resulting negative current values indicate more negative current flow than positive current, and positive net current values indicate more positive current flow over the period of time, respectively). Unbalanced developer current may lead to loss of conductivity at the developer roller (e.g., causing non-uniform ionic conductor distribution). The unbalanced developer current may also lead to less print fluid being transferred to the photoconductive drum. For instance, transfer of reduced amounts of print fluid to a substrate leads to reduced optical density, or reduced density of print fluid transferred to a latent image. Thus, to maintain print quality and optical density, it may be desirable to avoid formation of an accumulated developer current imbalance on the developer roller.

There may be a desire, therefore, for devices and methods to enable removal of residual print fluid from a developer roller (e.g., conductive print fluid), such as DR 102, while also avoiding loss of conductivity at the developer roller and reduction of optical density.

In one implementation, an accumulated developer current imbalance on a developer roller may be reduced or avoided (while still providing a differential voltage between a developer roller and a cleaner roller sufficient to remove residual print fluid from the developer roller) by providing compensating voltage pulses prior to impression (pre-impression compensating voltage pulses) or subsequent to impression (post-impression compensating voltage pulses) sufficient to reduce or avoid accumulated developer current (IDR) imbalance on DR 102. For instance, if a net developer current over a time period is A1, then compensating voltage pulses may be provided over a period of time sufficient to yield an accumulated developer current of Al such that a net developer current over the time period is approximately zero. Thus, compensating voltage pulses may be selected to be sufficient to cancel or reduce (e.g., partially cancel) previous accumulated developer current. The pre- and post-impression compensating voltage pulses are referred to herein as compensating voltage pulses and refer to voltage pulses added to the beginning of an impression cycle and/or after an impression cycle. Compensating voltage pulses may comprise a magnitude similar to that pulsed to components during a traditional impression cycle. Alternatively, compensating voltage pulses may have a different magnitude. Compensating voltage pulses may comprise voltage pulses of static duration (e.g., predefined) and/or magnitude. Alternatively, compensating voltage pulses may comprise dynamic voltage pulses determined based on current levels measured at a developer roller (e.g., based on integration of current levels measured at a developer roller). The compensating voltage pulses may cancel or reduce net current over a period of time in the developer roller, such as current generated in response to differential voltages between the developer roller and other components of a developer unit. The determination and application of compensating voltage pulses will be discussed in greater detail hereinafter in relation to the schematic illustration of a sample EP device in FIG. 2 and the plots of FIGS. 3-9.

Figure 2:
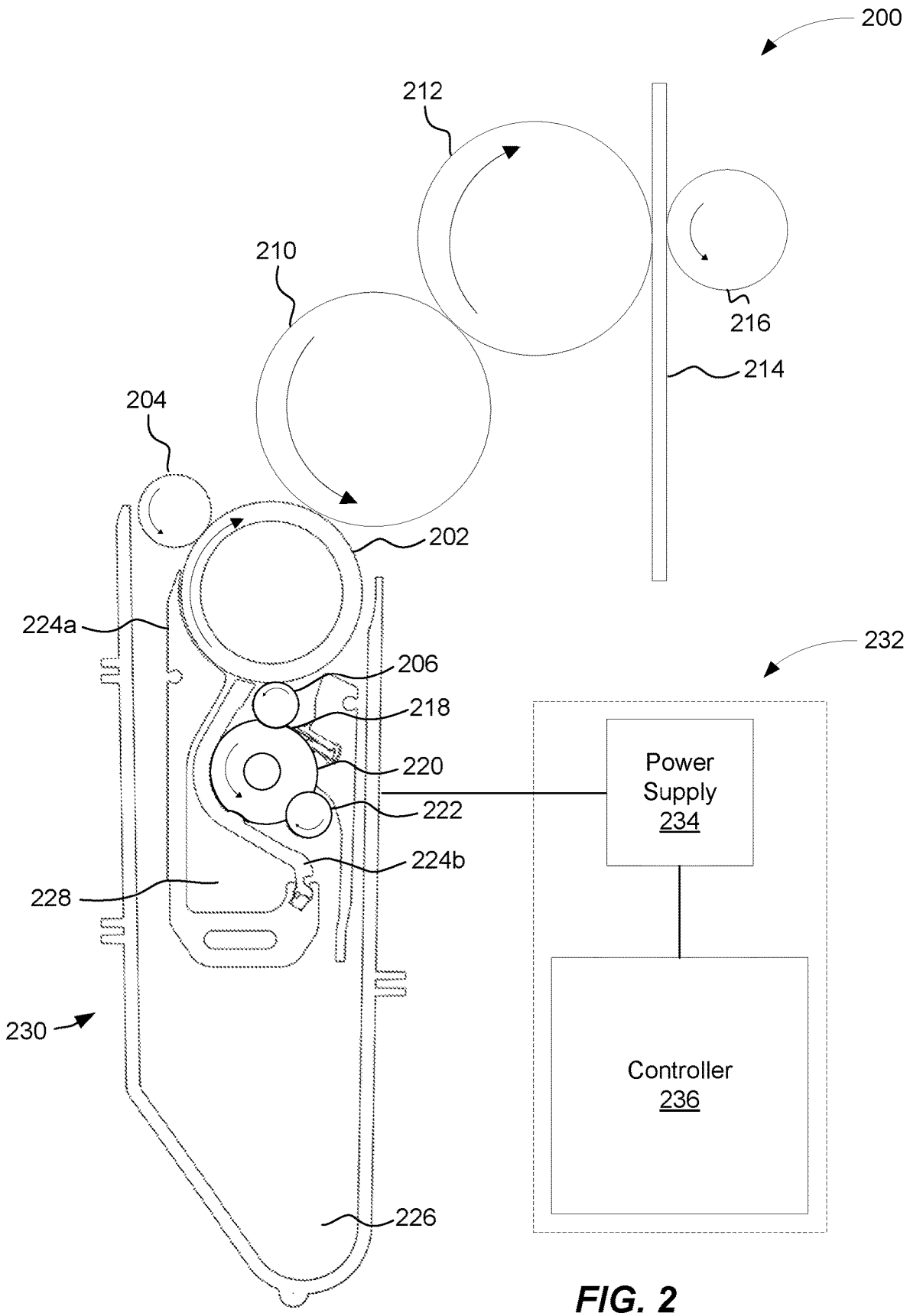
FIG. 2 is schematic diagram of another example electrophotographic device.

FIG. 2 is a schematic diagram illustrating another example EP device 200 comprising a developer unit 230, a photoconductive drum 210, an intermediate transfer member (ITM) 212, and an impression drum 216. As part of an impression cycle, developer unit 230 may develop print fluid and transfer the developed print fluid to photoconductive drum 210. The ITM 212 may be in contact with the photoconductive drum 210 to enable transfer of the developed print fluid corresponding to a latent image of photoconductive drum 210 to ITM 212. In one implementation, a number of developer units, such as developer unit 230, may be arranged in proximity to photoconductive drum 210 and/or ITM 212 and may each apply different portions (e.g., different separations) of a latent image (e.g., different colors, such as yellow, magenta, cyan, black, and silver, by way of non-limiting example) to ITM 212. Developed print fluid may be transferred to a substrate 214. To enable transfer of developed print fluid to substrate 214, substrate 214 may be pressed against ITM 212 by impression drum 216. A driving component 232 comprising a power supply 234 and a controller 236 may operate to set voltage potentials on respective components of developer unit 230 and to enable transfer of developed print fluid to substrate 214, such as in response to formed electric fields.

Developer unit 230 may include a print fluid cavity 228 into which a fluid inlet port from a reservoir (not shown) may lead. As noted above, in one example, print fluid may comprise a liquid and negatively charged solids. Developer unit 230 may comprise first electrode 224*a* and second electrode 224*b*, which may be usable to form an electric field between developer roller (DR) 202 and electrodes 224*a* and 224*b* (also referred to as ELs), such as in response to a differential voltage. DR 202, squeegee roller (SQ) 204, and cleaner roller (CL) 206 correspond to DR 102, SQ 104, and CL 106, discussed above. First electrode 224*a* and second electrode 224*b* may engender a large negative potential sufficient to cause the negatively charged solids to move to DR 202 from print fluid cavity 228, such as due to a less negative potential of DR 202. In one example, a potential of approximately −1175 V may be generated across first electrode 224*a* and second electrode 224*b*, which may engender formation of a differential voltage as to DR 202 (which may comprise a rubber base with an ionic conductor, as discussed above) and which may have a potential of approximately −600 V.

In response to the differential voltage between the electrodes 224*a* and 224*b* and DR 202, print fluid may coat DR 202. DR 202 may rotate (e.g., in a clockwise direction in an example case illustrated in FIG. 2) coating its surface during impression. DR 202 may be brought into contact with SQ 204, which may be used to remove excess print fluid from DR 202 and concentrate charged solids onto the surface of DR 202. During an impression cycle, SQ 204 may be charged to a negative potential relative to DR 202. For example, in one case, DR 202 may have a potential of approximately −600 V, and SQ 204 may have a potential of approximately −900 V. Thus, negatively charged print fluid solids may be concentrated on DR 202, while removing excess liquids from DR 202. Removal of fluids may be accomplished through application of mechanical and electrical forces to the print fluid coating DR 202 to expel liquids. As such, print fluid on DR 202 that has come into contact with SQ 204 may comprise approximately 80% liquid and 20% solids, by way of non-limiting example.

Increasing a concentration of solids in print fluid is referred to herein as "developing" the print fluid, and the resulting print fluid with the increased concentration of solids is referred to herein as "developed" print fluid. The developed print fluid may be a non-Newtonian fluid and may have a paste-like consistency.

Moving on, during impression, developed print fluid may be transferred from DR 202 to photoconductive drum 210. In one implementation, to receive developed print fluid from DR 202, a surface of photoconductive drum 210 (also referred to as a photo imaging plate, or PIP) may be uniformly negatively charged (of course, a positively charged photoconductive drum may be used with an appropriately charged print fluid). A latent image may be formed on the surface of photoconductive drum 210 by selectively discharging portions of the surface, such as in response to exposure to light (e.g., laser light, LED light, etc.). DR 202 may transfer developed print fluid to the selectively discharged portions of the surface of photoconductive drum 210. Developed print fluid not transferred to photoconductive drum 210 may remain on DR 202; this remaining developed print fluid is referred to herein as residual print fluid.

Residual print fluid may be cleaned from DR 202, such as to avoid residual print fluid from eventually being transferred to photoconductive drum 210 in subsequent portions of an impression cycle and/or subsequent impression cycles (e.g., image memory, as discussed above). In one example, DR 202 may be rotated into contact with CL 206, which may have a less negative voltage potential as compared to DR 202. The voltage potential of CL 206 may be selected to enable removal of residual print fluid from DR 202. In one example implementation, CL 206 may have a potential of approximately −400 V compared with an approximate potential of −600 V of DR 202. As such, a differential voltage may exist at DR 202 due to a difference in voltage potentials at SQ 204 and CL 206 (and also the differential voltages between DR 202 and other components of EP device 200). As noted above, the differential voltages at DR 202 may yield an accumulated developer current imbalance which may be undesirable, such as in cases of a developer unit 230 for conductive print fluids.

Wiper blade 218 is arranged with regards to CL 206 for removal of residual print fluid from CL 206. A sponge roller 220 may move removed residual print fluid from CL 206 and wiper blade 218. Removed residual print fluid may be remixed with undeveloped print fluid, and thus a squeezer roller 222 may remove print fluid from sponge roller 220 through the application of pressure, thus releasing print fluid to drain into tray 226. A conduit (not shown) arranged in tray 226 may enable transfer of print fluid from tray 226 to a reservoir.

Driving component 232 may include a controller 236 in communication with a power supply 234. In one example, driving component 232 may comprise a single integral controller 236 and a single integral power supply 234. In other examples, functionality of controller 236 and power supply 234 may be distributed among a plurality of controllers and/or power supplies. Power supply 234 may drive the potentials of ITM 212, photoconductive drum 210, the components of developer unit 230, etc. Controller 236 may indicate to power supply 234 the potential at which to set each respective component (e.g., DR 202, SQ 204, and CL 206). As used herein, the term controller refers to hardware (e.g., a processor, such as an integrated circuit, or analog or digital circuitry) or a combination of software (e.g., computer executable instructions that may be executed by a machine or computer, commands, or code such as firmware, a device driver, programming, object code, etc.) and hardware (but not software per se). The term "hardware" refers to hardware elements without software elements such as an application specific integrated circuity (ASIC), a field programmable gate array (FPGA), etc. The term "power supply" refers to a combination of hardware, microcontrollers, and firmware to output electrical energy at particular voltages (e.g., to regulate voltage and meet a target voltage, etc.). For example, the power supply may output electrical energy at voltages indicated to the power supply. The power supply may modify the voltages dynamically, for example, based on communications from the controller. The power supply may include software as well as hardware in some examples.

With the foregoing in mind, an example impression cycle is discussed to illustrate example operation of a developer unit, such as developer unit 230 in FIG. 2. As noted above, impression refers to the act of forming an image and/or text on a substrate, such as paper, by a developer unit 230. Thus, for example, adhering a single plane of each of cyan, magenta, yellow, and black on a substrate would comprise four impressions. With that in mind and as used herein, "impression cycle" refers to the acts or processes (e.g., startup, impressions, and shutdown) that, in the aggregate, yield formation of an image and/or text on a substrate. For example, for an EP device having multiple developer units, an impression cycle may comprise the charging of rollers (e.g., startup), the transfer of print fluid to a substrate for respective developer units of the EP device (e.g., respective impressions), and the cleaning and discharging of rollers (e.g., shutdown). If an EP device is a color EP device with yellow, magenta, cyan, black, and silver developer units, for example, then an impression cycle may comprise (1) the charging of developer rollers, squeegee rollers, and cleaner rollers, (2) the transfer of print fluid to a photoconductive drum of print fluid of the respective colors, and the transfer of yellow, magenta, cyan, black, and silver image portions from the photoconductive drum to an intermediate transfer member and then a substrate (e.g., five impressions assuming a single plane for each of yellow, magenta, cyan, black, and silver developer units), and (3) the cleaning and discharge of the rollers (e.g., shutdown). The following discussion will examine the operation of a single developer unit and assume, merely for simplicity, that for an EP print device with multiple developer units, the operation of the other developer units is approximately similar. That is, the operation of a single developer unit (e.g., pulsing voltages to rollers, transferring print fluids, etc.) will be assumed to be representative for other developer units in terms of timing, etc. Of course, as noted above, some print fluids may have differing characteristics, such as conductivity, that may lead to differing developer units (e.g., differing developer roller rubber layers, etc.) and charge values. For simplicity, such differences are not addressed in the discussion of the following plots. To be clear, however, this is done without limitation, and the plots are merely presented to illustrate operation of one possible implementation.

Figure 3:
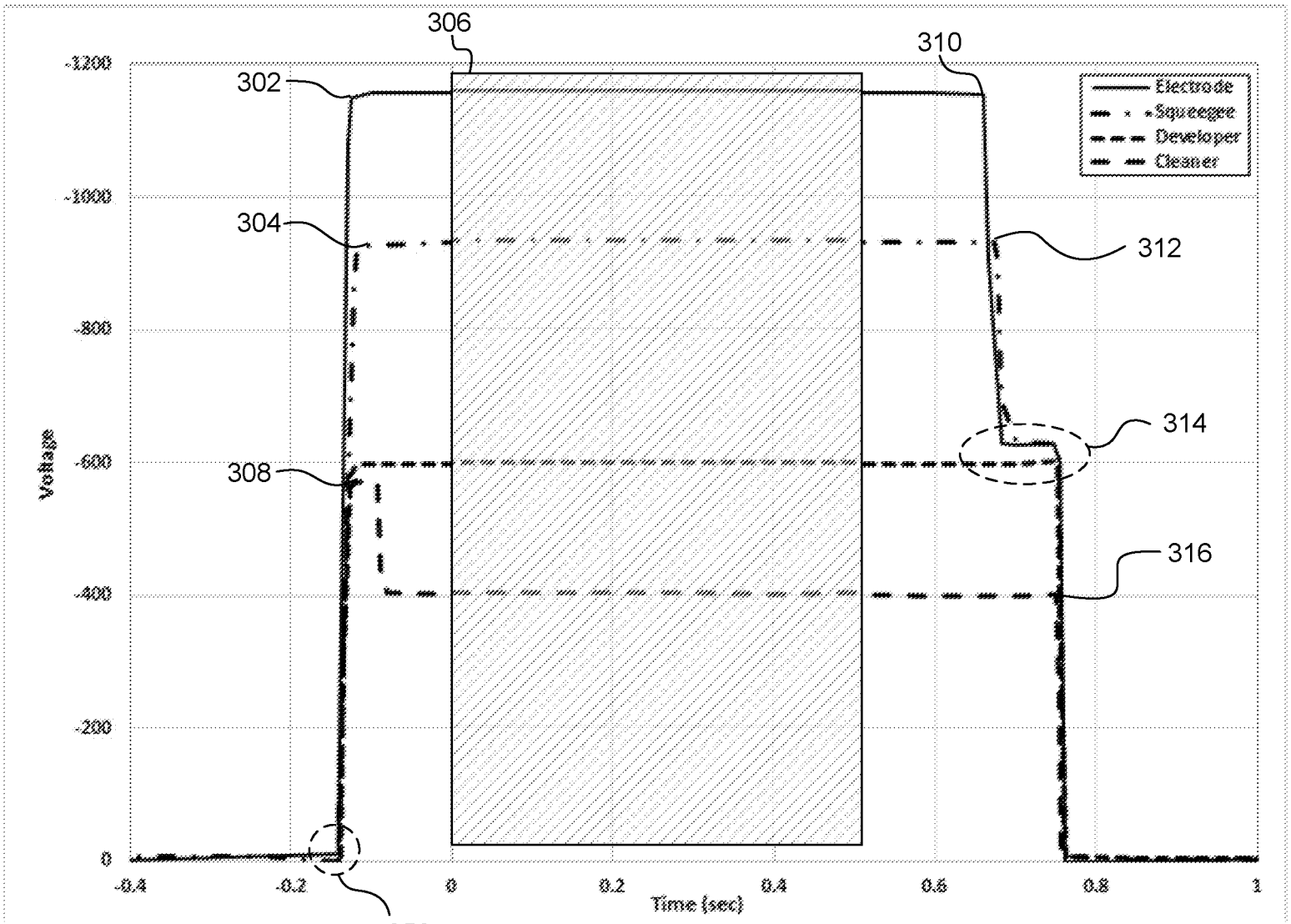
FIGS. 3-6 are plots of voltage levels at different components of an example developer unit during sample impression cycles.

FIG. 3 is a plot illustrating voltage potentials of various components of an example developer unit before, during, and after impression. For instance, voltage potential at the electrodes (e.g., first electrode 224*a* and second electrode 224*b* of developer unit 230 in FIG. 2) of a developer unit is presented with a solid line. Voltage potential at the squeegee roller (e.g., SQ 204 from FIG. 2) is presented with a combination dash-dotted line. Voltage potential at the developer roller (e.g., DR 202 from FIG. 2) is presented with a broken line. And voltage potential at the cleaner roller (e.g. CL 206 from FIG. 2) is presented with a broken line with larger spaces and dashes than the line for the developer roller.

Of note, the plot of FIG. 3 presents voltage versus time with the x-axis presenting time from a time, t=−0.4 seconds to a time, t=1 second. In this example case, impression (306) occurs from time t=0 seconds to approximately t=0.5 seconds. As mentioned above, voltage potentials prior to time t=0 seconds and after time t=0.5 seconds are also part of the impression cycle for impression 306. Also of note, the y-axis of the plot of FIG. 3 spans from 0 V to −1200 V. As noted above, presence of a negative potential (e.g., negative with respect to a ground) may facilitate movement of print fluid from, for example, a print fluid collection part (e.g., print fluid cavity 228 of FIG. 2) to a developer roller (e.g., DR 202). Thus, in FIG. 3 a negative potential of approximately −1175 V is measured at the electrodes, a potential of approximately −900 V is measured at the squeegee roller, a potential of approximately −600 V is measured at the developer roller, and a potential of approximately −400 V is measured at the cleaner roller (with a slight spike up to nearly −600 V at time approximately t=−0.25).

In this example, the impression cycle shown in FIG. 3 corresponds to impression on a single substrate (e.g., a single page or a frame of a web). In one case, a desired impression may comprise forming images and/or text on multiple substrates or a multi frame job on different locations of a web or roll of substrate (e.g., a multi-page print job). For the case of a print job spanning twenty pages, for instance, twenty or more (e.g., such as for a multi-color print job) impression cycles may occur from the start to the end of the print job. After each impression or each impression cycle, a net developer current may be unbalanced (e.g., such as being net positive or net negative) and may become further unbalanced with subsequent impression cycles thus leading to, among other things, non-uniform ionic conductor distribution, reduced developer roller conductivity, and optical density, as discussed above.

Turning to FIG. 3, prior to impression 306, the electrodes, squeegee roller, developer roller, and cleaner roller of a developer unit at 350 are set at differing voltage potentials. As should be apparent, 350 occurs at approximately −0.15 seconds. Said otherwise, the example developer unit begins pulsing voltage to rollers approximately 0.15 seconds prior to transferring print fluid to a substrate. At 302, electrodes have a potential of approximately −1175 V and at approximately the same time, a potential of approximately −600 V (or nearly 600 V less negative than the electrodes) is measured at the developer roller to enable concentration of print fluid solids at the developer roller. At approximately the same time, as shown at 304, the squeegee roller has a potential of approximately −900 V to enable removal of excess print fluid from the developer roller and concentration of negatively charged print fluid solids on the developer roller. In the block 306 indicating impression, print fluid is transferred from the developer roller to a photoconductive drum with a latent image. The cleaner roller has a potential of approximately −400 V (after the drop at 308) to remove residual print fluid from the developer roller (e.g., attracting the negatively charged print fluid from the more negatively charged developer roller).

After impression is completed, the electrodes and squeegee roller drop (see, e.g., 310 and 312) to approximately a same potential as the developer roller so as to cease concentrating print fluid solids at the developer roller. The less negative potential of the cleaner roller is maintained for slightly longer (as shown at 316 in view of 314), such as to fully clean the developer roller (e.g., remove residual print fluid). Thereafter, voltage is no longer pulsed to the electrodes, squeegee roller, developer roller, and cleaner roller (316). As discussed above, after 316, residual charge (and non-uniformity of ionic conductor) may exist at the developer roller, such as due to an unbalanced developer current.

With subsequent impression cycles, an imbalance of current traversing the developer roller increases (e.g., current*time). Said otherwise, an integration of current over time may move further from zero with subsequent impression cycles. As the accumulated developer current imbalance increases, ionic conductors in a developer roller may become non-uniformly distributed, thus leading to increased resistance and conductivity loss of the developer roller. As a result, the developer roller may experience, in some cases, reduced ability to discharge between cycles (e.g., causing image memory). Additionally, with increasing resistance of the developer roller, optical density of print fluid solids concentrated at the developer roller and the photoconductive drum decreases, referred to as optical density instability (OD).

As mentioned above, compensating voltage can be used before and/or after impression in order to reduce accumulated developer current imbalance on the developer roller over a period of time. The following table (Table 1) presents empirical results for an example EP device that was tested using an approach consistent with what is discussed herein.

TABLE 1

| $V_{SQ}$ bias | $V_{CL}$ bias | Δ bias | OD change (%) | Cumulative developer current (μA*sec) |
|---|---|---|---|---|
| 400 | −100 | 300 | −34% | 94 |
| 400 | −200 | 200 | −25% | 63 |
| 400 | −300 | 100 | −5% | 40 |
| 400 | -400 | 0 | 1.7% | 11 |

The current measurement and OD determination are based upon an example impression of twenty pages. As should be apparent, different voltages (which may be desirable to avoid or reduce image memory) may have a negative effect on OD stability (e.g., caused by charge buildup on the developer roller).

Pulsing compensating voltage to the developer unit represents one method for reducing accumulation of current imbalance at the developer roller. Indeed, because differential voltage at the developer roller is based on a combination of differential voltages between the developer roller and other components of the developer unit, a compensating voltage pulse may reduce or cancel accumulated current imbalance on the developer roller. In one example, this may be accomplished by using static pulse values (e.g., static times, static magnitude, etc.) provided before or after impression to cancel accumulated current imbalance at the developer roller. The static pulse values may be determined based on typical use. For instance, a compensating voltage pulse of an added 0.2 seconds may be added to the end of a cleaner roller voltage pulse to reduce accumulated current imbalance at the developer roller in one example case based on typical use of a developer roller. In another example case, a voltage pulse of an added 0.1 seconds at −200 V may be added to the end of a cleaner roller voltage pulse to reduce differential voltage at the developer roller in another example case. It is noted that in one implementation, one or more controllers and power supplies, similar to power supply 234 and controller 236 of FIG. 2, may be used to determine and provide compensating voltage pulses.

Figure 4:
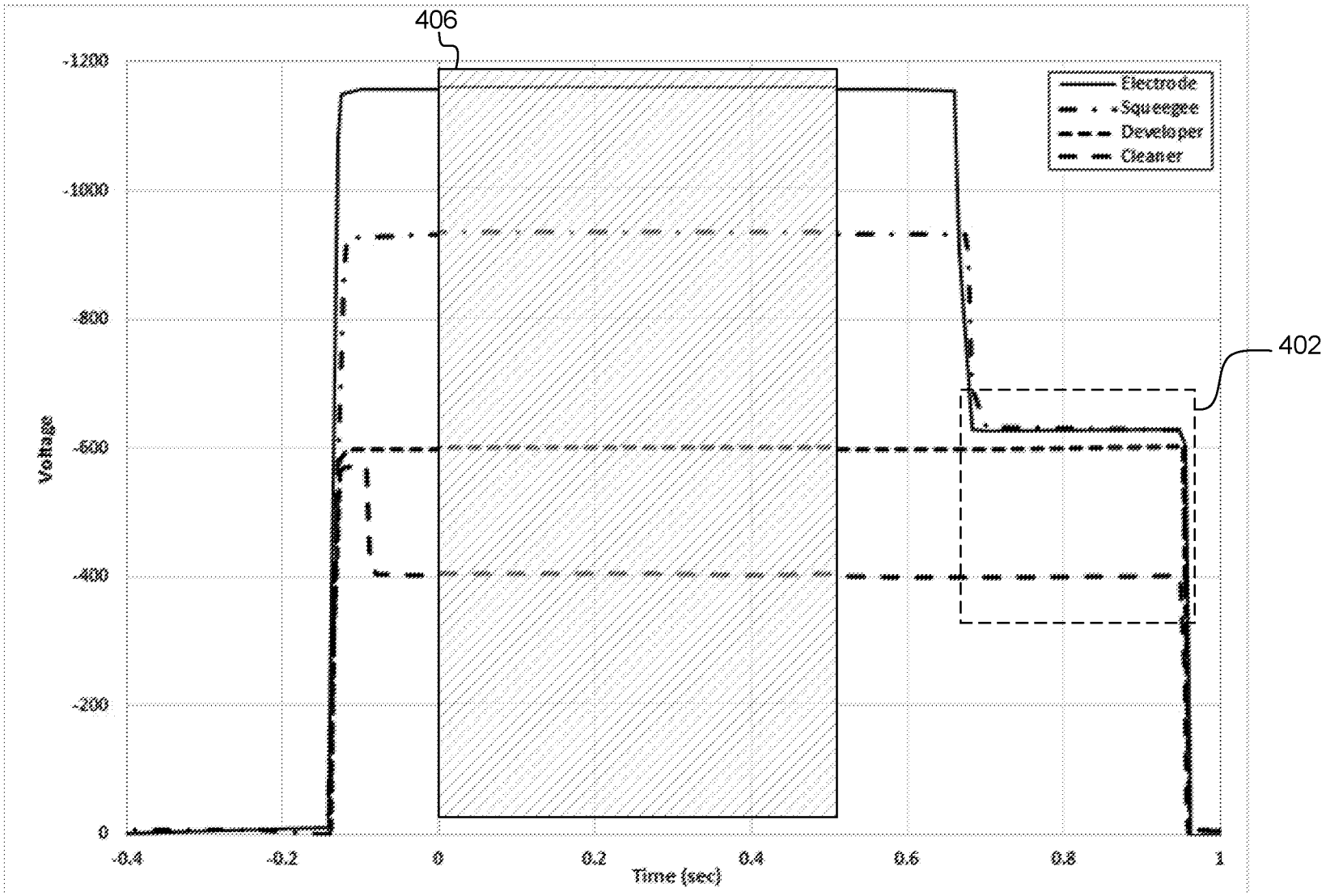

FIG. 4 is a plot of an impression cycle (including impression 406) having a post-impression compensating voltage pulse to reduce an accumulated current imbalance at a developer roller. Referring to 402, a compensating voltage pulse is transmitted to a cleaner roller (at approximately −400 V) to extend the post-impression cycle time out to approximately 0.95 seconds. Comparing 314 in FIG. 3 with 402 in FIG. 4, it should be apparent that approximately 0.1 second of post-impression compensating voltage to the cleaner roller is added. In the case of static post-impression voltage pulses, the approximately 0.1 second of post-impression compensating voltage pulse at approximately −400 V may be determined based on typical use of a developer unit (e.g., determined empirically). For instance, it may be determined that such a voltage pulse may prevent or reduce reduction in optical density. It is noted that such a static approach may also be applied before impression in an impression cycle, without limitation.

In contrast to providing static pre- or post-impression compensating voltage pulses, in another implementation compensating voltage pulses may be determined dynamically, such as based on current measurements at a developer roller. For example, periodic measurements may be made at a developer roller and determinations as to appropriate compensating voltage pulses may be made based on those periodic measurements. For example, developer current, $I_{DR}$, may be integrated over time to find an accumulated imbalance. A correction pulse may be determined to provide an imbalance in an opposite direction (e.g., compensating current*time). For example, if the accumulated imbalance is −A, then an imbalance in the opposite direction may comprise +A.

Figure 7:
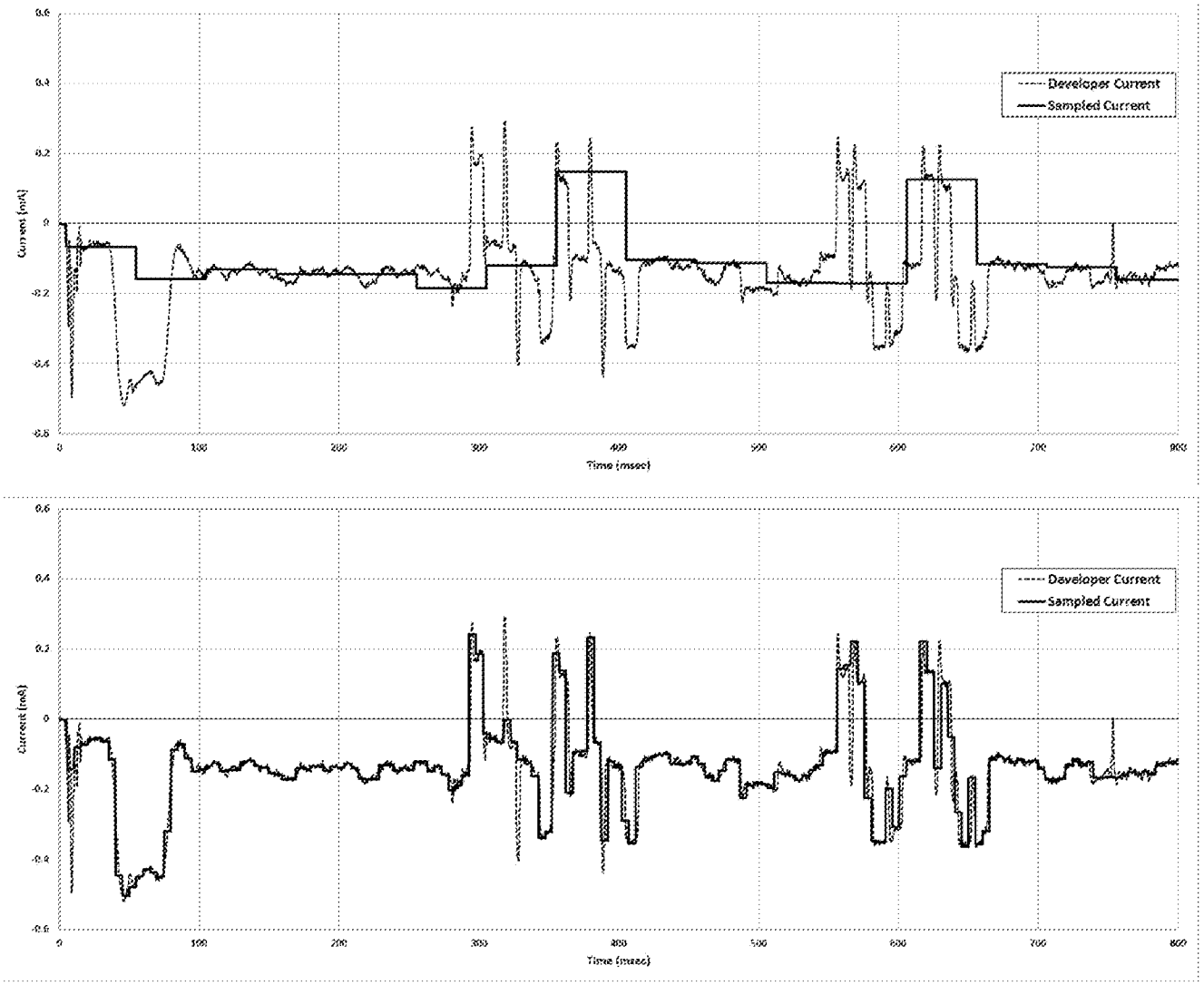
FIG. 7 includes two plots (plots (a) and (b)) illustrating different example developer current sample rates.

FIG. 7 shows two plots that illustrate considerations to take into account when sampling current levels at the developer roller. The plot (a) shows an actual developer current with a broken line and how the values of the plot look when sampled every approximately 50 ms, as illustrated with the solid line. As should be apparent, sampling at 50 ms may not provide accurate accumulated current imbalance values. Indeed, $I_{DR}$ can change frequently and sharply, and much of those values are not reflected in the values sampled in plot (a).

In contrast, plot (b) of FIG. 7 shows the same developer current sampled every 5 ms. As should be apparent, using a smaller sampling period may be desirable, such as for yielding more precise measurements of $I_{DR}$. Indeed, most current peaks and valleys are captured by the sampled current values (solid line).

With the observation of plots (a) and (b) of FIG. 7 in mind, in one case it may be desirable that sampling periods be set at a frequency that is greater than a frequency of oscillation of the developer current. Indeed, the sampled current in FIG. 7 appears to show some oscillation (e.g., between approximately 300 ms and 400 ms and again between approximately 550 ms and 650 ms). The frequency of this oscillation appears to be approximately one cycle per 50 ms, or approximately 0.02 cycles per millisecond, which converts to approximately 20 cycles per second or 20 Hz. Thus, use of a sampling frequency that is greater than 20 Hz in this case (e.g., a sampling period less than 50 ms) may be desirable.

Figure 8:
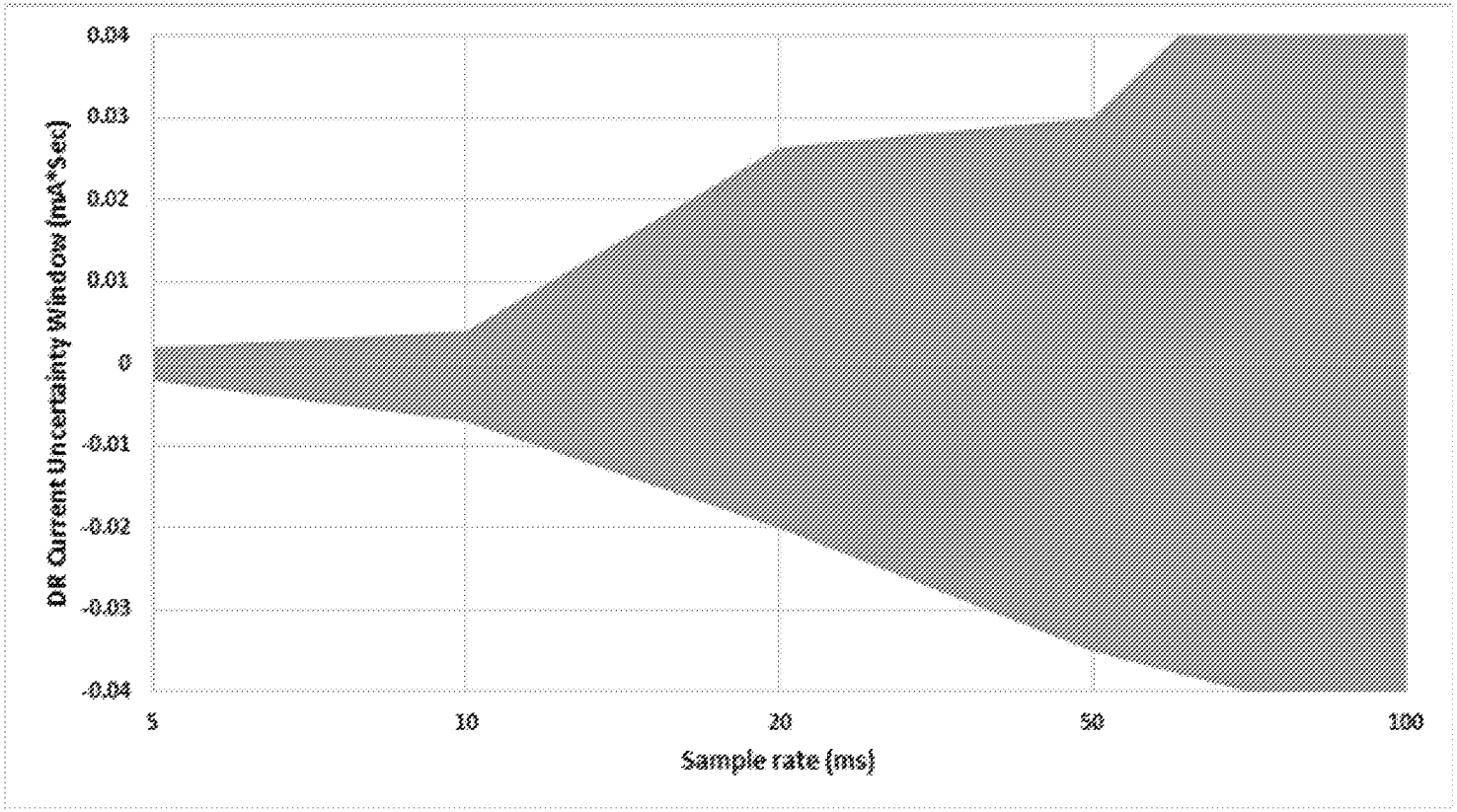
FIG. 8 is a plot of accumulated developer current imbalance uncertainty based on sampling periods for developer current.

This example sampling period is borne out in FIG. 8. Briefly, FIG. 8 is a plot illustrating accumulated developer current imbalance uncertainty as a function of sampling period. As the sampling period increases, so does the uncertainty as to actual accumulated current imbalance levels in the developer roller (as opposed to sampled levels). In one example, it may be determined that 10 ms may provide a sampling period that may yield an acceptable level of accuracy. Such a determination may be made for a number of possible implementations to determine a desired sampling period.

Using the above methods or the like, pre-impression and post-impression compensating pulses may be determined. In one implementation, compensating pulses may be determined based on current levels at a developer roller. It may be determined, for instance, that an accumulated current imbalance at a developer roller may be correlated to a number of pages printed, and yield a corresponding compensating voltage pulse. The following table (Table 2) presents some sample values to illustrate compensating voltage duration for one sample case. It is noted that these numbers were derived empirically in a closed loop system and are specific to this particular example (e.g., specific print job, print fluid condition, etc.). By applying these compensation pulses, the accumulated developer current imbalance may be driven toward zero. Of course, as would be readily understood by those of skill in the art, different print jobs at different times with different developer and print fluid conditions, the resulting compensating voltage pulse values may also be different.

TABLE 2

| Sheets | Compensating voltage duration to yield aggregated developer current approaching zero |
|---|---|
| 10 | 40 ms |
| 20 | 160 ms |
| 30 | 170 ms |
| 40 | 170 ms |
| 50 | 80 ms |
| 60 | 80 ms |
| 70 | 140 ms |

The compensating voltage pulses in Table 2 may be added to an end of an impression cycle or may be added to the beginning of an impression cycle, without limitation.

Thus, rather than being a plot showing static post-impression compensating voltage pulses, in one case the plot of FIG. 4 may represent dynamic post-impression compensating voltage pulses determined consistent with the foregoing. Indeed, the post-impression compensating voltage pulses shown at 402 may have been determined dynamically, such as based on measurements of current at the developer roller. As noted above, the developer current may be the result of a number of differential voltages or formed electric fields. For instance, a developer current may be based on a first field between a developer roller and an electrode, a second field between a squeegee roller and the developer roller, a third field between a photoconductor and the developer roller, and a fourth field between the developer roller and a cleaner roller. A voltage potential may be applied to a component of the developer unit, such as the cleaner roller before or after impression in order to counter the accumulated developer current imbalance. For example, the added compensating voltage pulse shown after approximately 0.75 seconds can be considered an additional voltage pulse (as opposed to, for example, a continuation of a same voltage pulse), without limitation. In this example, then, the voltage potential after approximately 0.75 seconds at the cleaner roller can be considered a compensating voltage pulse. It is noted that in addition to (or as an alternative to) providing a voltage pulse of a given time, a magnitude of voltage pulses may be adjusted at the cleaner roller.

Figure 5:
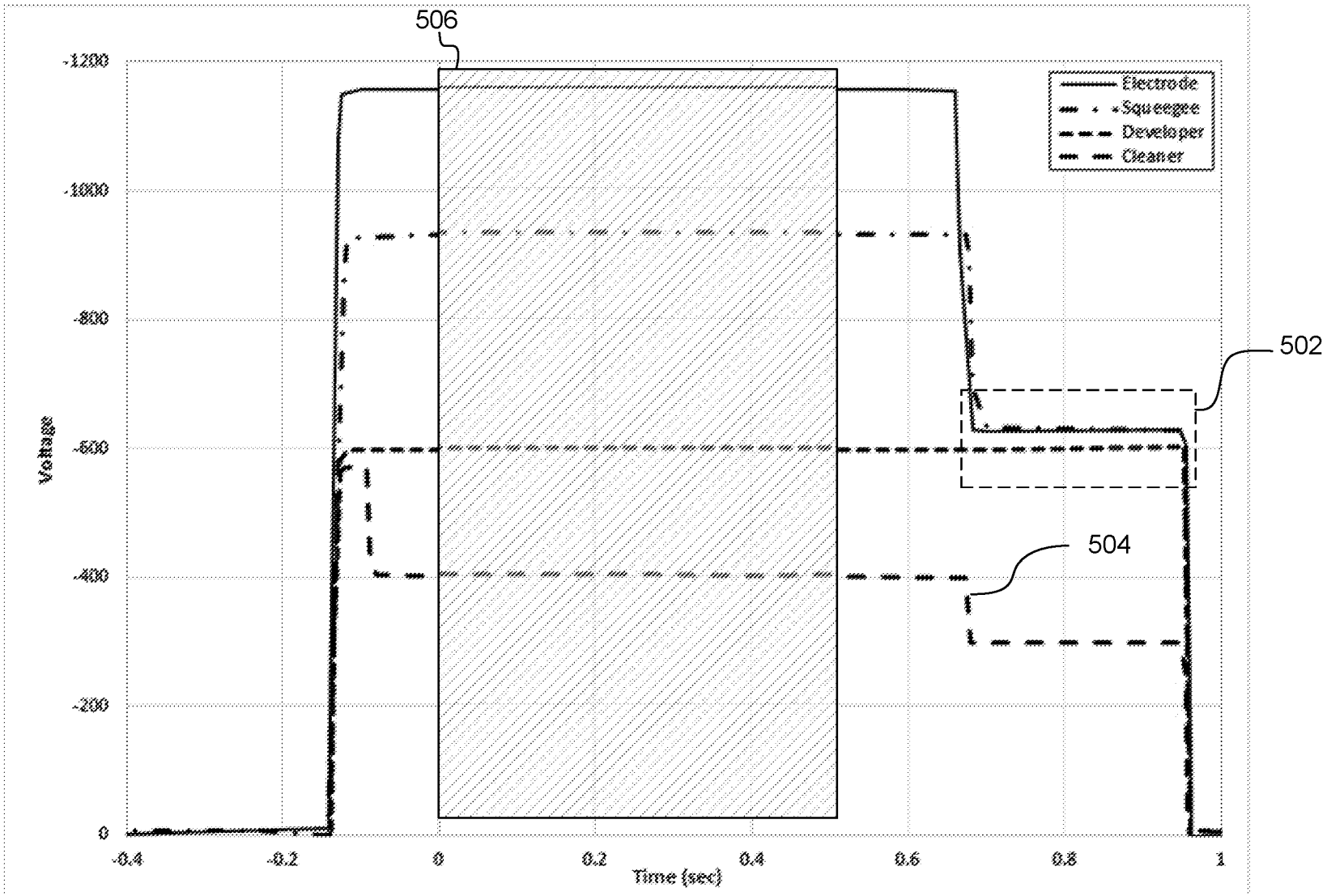
Figure 6:
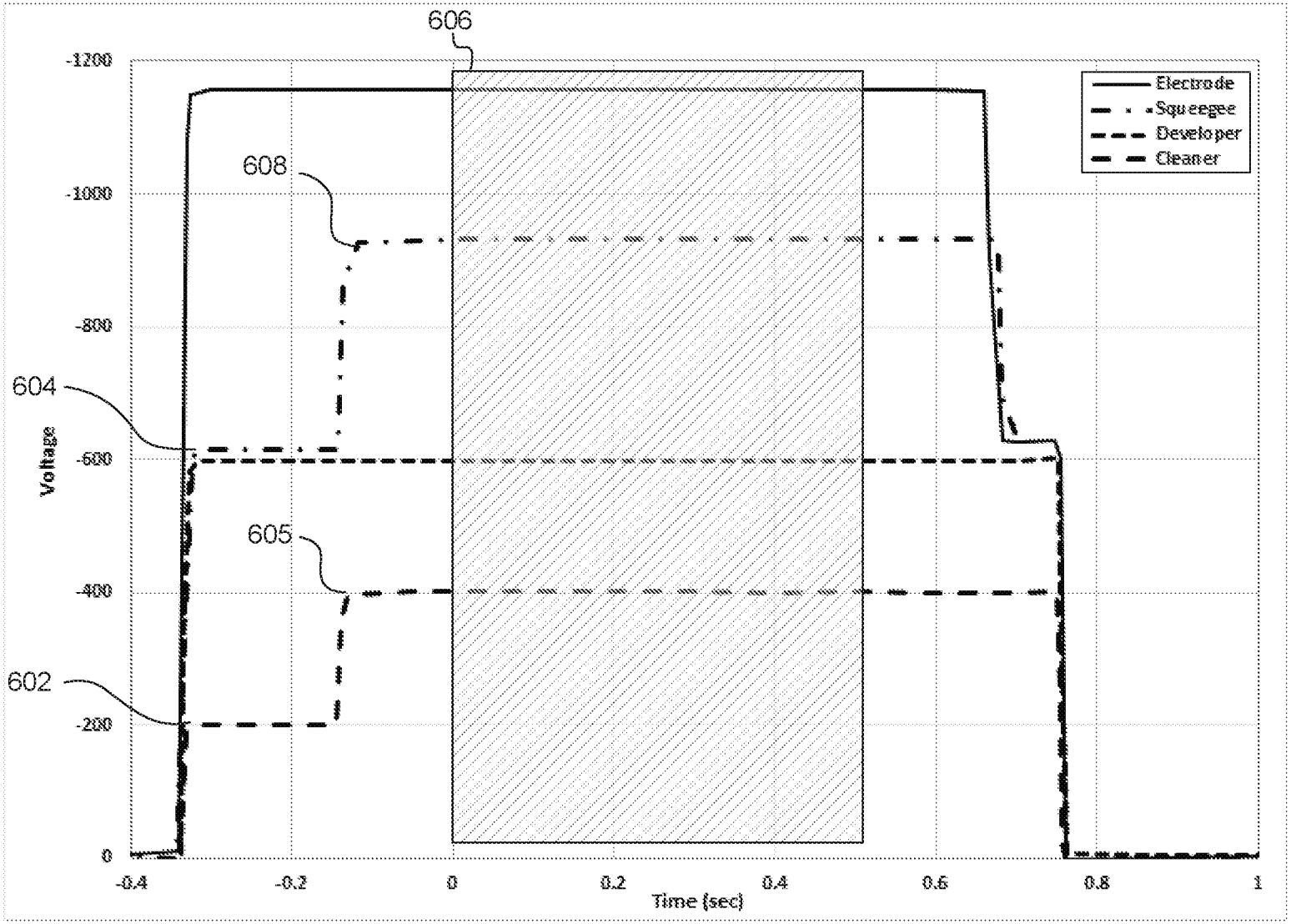

FIG. 5 is a plot of an impression cycle (including impression 506) illustrating a case in which a magnitude of a voltage pulse to a cleaning roller, VCL, is adjusted as shown at 504, as part of a post-impression compensating voltage pulse. It may be that, for instance, a duration of a compensating voltage pulse may be reduced in view of adjustments to a magnitude of a voltage pulse to a cleaner roller. In another case, adjusting a magnitude of a compensating voltage pulse may complement a duration of voltage pulse. Indeed, as should be apparent by comparing 502 at FIGS. 5 and 402 at FIG. 4, a duration of a voltage pulse may remain approximately the same and compensating voltage pulses to the cleaner roller can be adjusted.

In contrast to the post-impression approaches discussed with respect to FIGS. 3-5, FIG. 6 illustrates a case in which pre-impression compensating pulses are used (e.g., rather than post-impression compensating pulses) as part of an impression cycle (including impression 606). Pulses to the cleaning roller and the squeegee roller set voltage potentials to initial values of approximately −200 V and approximately −600 V, respectively before approximately −0.35 seconds (see, e.g., 602 and 604). Subsequently, at 605 and 608, voltage potentials at the squeegee roller and the cleaner roller increase in magnitude to approximately −400 V and −900 V, respectively. Comparing 605 and 608 with 304 and 308 in FIG. 3, it should be apparent that the compensating voltage pulses occur prior to 605 and 608 (e.g., at approximately −0.15 seconds).

Figure 9:
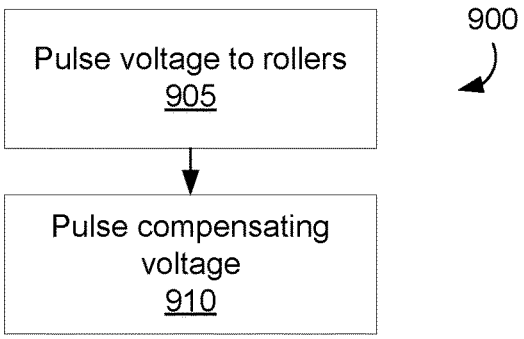
FIGS. 9 and 10 are flow diagrams of sample methods of impression and application of compensating voltage.
Figure 10:
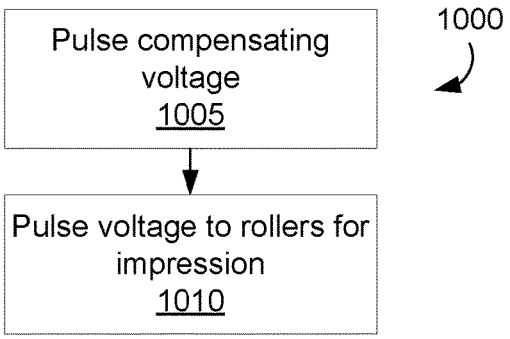

With the foregoing in mind, reference is made to example method 900 of FIG. 9. Example method 900 illustrates a sample case in which compensating voltage pulses are transmitted (block 910) after transmitting current to rollers of an EP device (block 905), such as to a developer roller, a squeegee roller, and a cleaner roller, by way of example. In contrast, method 1000 of FIG. 10 illustrates an implementation in which pre-impression compensating voltage pulses are transmitted (block 1005) prior to impression (block 1010), similar to the case illustrated in FIG. 6.

Figure 11:
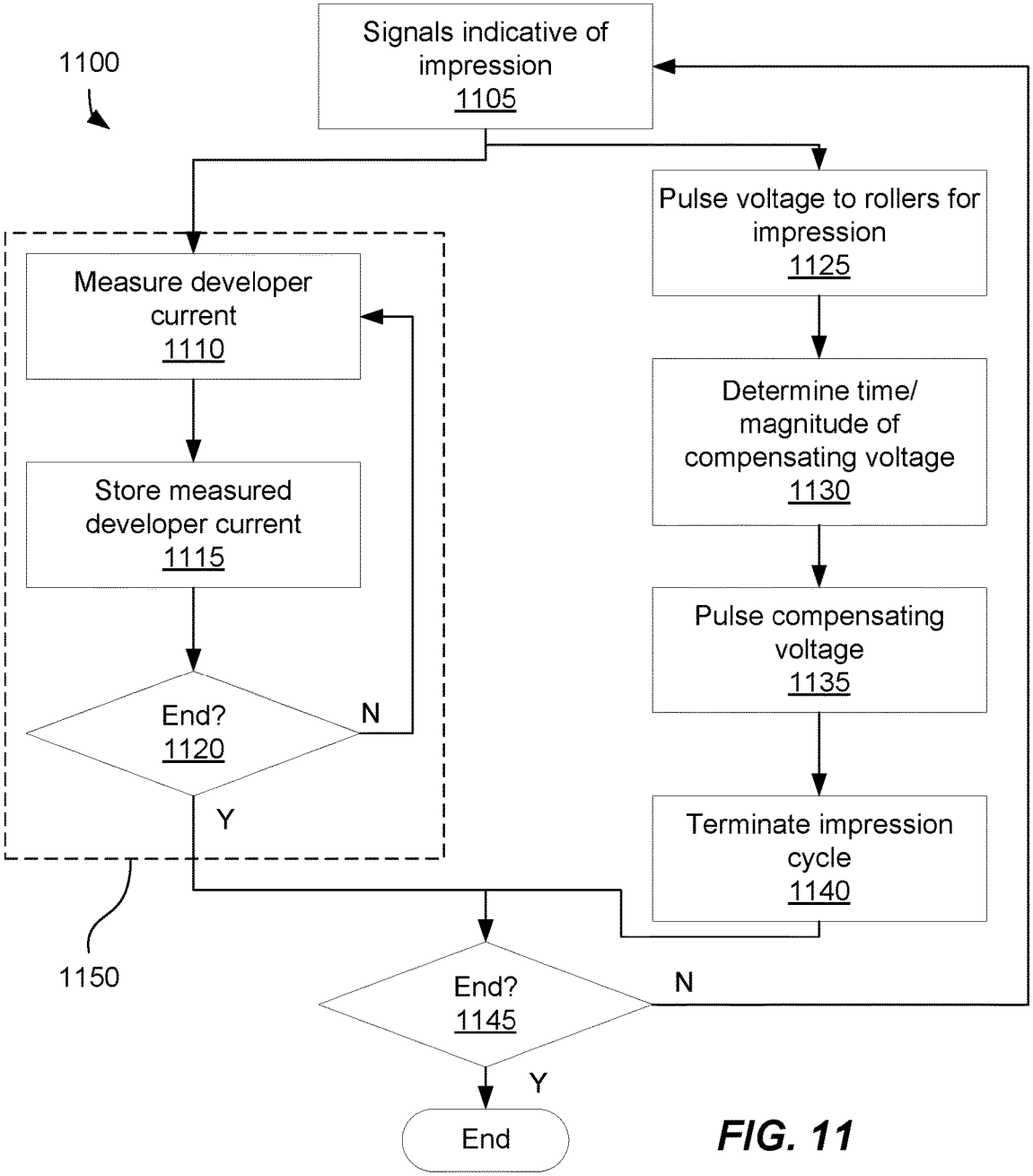
FIG. 11 is a flow diagram illustrating a sample impression method.

FIG. 11 illustrates a sample method 1100 for using dynamic measurements of developer roller current to determine compensating voltage duration and/or magnitude. Method 1100 uses an assumption that current sampling (block 1150) occurs when signals indicative of impression are received at an EP device. For instance, sampling when a developer unit of an EP device is otherwise idle may not be desirable because it might lead to unnecessary resource usage among other things. However, this description is without limitation, and other implementations are contemplated by the present disclosure. At a block 1105, an EP device may receive signals indicative of a start of an impression cycle. Sample signals may include signals sent to an EP device, such as from a computing device, with instructions to form an image on a substrate. The signals may be received at a controller, such as controller 236 in FIG. 2. In one implementation, reception of such signals (and the like) may trigger a sampling loop at a developer roller (block 1150). The sampling loop may comprise measuring $I_{DR}$ (block 1110) and storing the measured value (block 1115). The sampling and storing may also be implemented by the controller. The sample loop may also make a determination (e.g., block 1120) as to whether an impression cycle has terminated. If the impression cycle has not terminated, then the sampling loop may continue. In one case, $I_{DR}$ may continue to be sampled for a predetermined period of time after the impression cycle. In any case, in this implementation, subsequent to detecting an end of an impression cycle, the sampling loop may end. It is noted that a periodicity of current sampling may be determined consistent with the above explanation of FIGS. 7 and 8.

Forming an image on a substrate may comprise setting voltage potentials at rollers of an EP device (block 1125). A magnitude and/or duration of compensating voltage may be determined based on the measured/stored $I_{DR}$ values (block 1130) and consistent with the above discussion of FIGS. 3-6. At block 1135, compensating voltage may be pulsed. In one case, a controller may transmit signals to a power supply, such as power supply 234 of FIG. 2, in response to which compensating voltage pulses may be transmitted to a developer unit. At block 1140, the impression cycle may be terminated. A determination may be made as to whether the print job is completed, as shown at block 1145. If yes, then the routine may be terminated. Otherwise, the routine may cycle back up to block 1105.

The foregoing description provides description of methods and apparatuses capable of balancing current in a developer roller, such as by providing pre-impression or post-impression voltage pulses. For instance, in one example a method of balancing current in a developer roller includes: pulsing voltage to a squeegee roller and a cleaner roller yielding a differential voltage at the developer roller after impression. Compensating voltage pulses are transmitted to at least one of the squeegee roller or the cleaner roller to reduce or cancel an accumulated developer current imbalance. The compensating voltage pulses comprise pulses before or after the impression.

In another implementation, an electrophotography printing device includes a developer roller, a photo imaging plate (PIP), a cleaner roller, a power supply, and a controller. The developer roller attracts a charged print fluid in response to application of an electric field. The PIP is arranged to rotate in proximity (e.g., in contact) to the developer roller and attract print fluid from the developer roller. The cleaner roller is arranged to rotate in contact with the developer roller and to remove residual print fluid from the developer roller. The power supply is to set voltage potentials of the developer roller, squeegee roller, electrodes, the PIP, ITM, and the cleaner roller. And the controller is to transmit signals to the power supply. The signals transmitted to the power supply from the controller include signals to instruct the power supply to: (a) pulse voltage to the cleaner roller and the developer roller thus yielding a differential voltage at the developer roller after impression; and (b) pulse compensating voltage to the cleaner roller to reduce or cancel an accumulated developer current imbalance of the developer roller based on the differential voltage. The compensating voltage pulses include pulses before impression, pulses after impression, or a combination thereof.

In yet another implementation, a method of transferring a print fluid comprising conductive particles from a developer roller (DR) to a photo imaging plate (PIP) includes: (a) forming a first field between the DR and an electrode by setting, using a power supply, a first voltage at the electrode, wherein in response to the formed first field the print fluid is attracted to the DR from a fluid collection part of a developer unit; (b) forming a second field between a squeegee roller (SQ) and the DR by setting, using the power supply, a second voltage at the SQ, wherein the second field concentrates print fluid solids on the DR; (c) transferring the print fluid to the PIP based on a third field between the PIP and the DR; and (d) removing residual print fluid from the DR based on a fourth electric field formed between the DR and a cleaner roller (CL). A developer current is formed at the DR in response to the first field, the second field, the third field, and the fourth field. The method further includes transmitting a compensating voltage to the CL to counter the accumulated developer current imbalance at the DR.

In the preceding description, various aspects of claimed subject matter have been described. For purposes of explanation, specifics, such as amounts, systems and/or configurations, as examples, were set forth. In other instances, well-known features were omitted and/or simplified so as not to obscure claimed subject matter. While certain features have been illustrated and/or described herein, many modifications, substitutions, changes and/or equivalents will now occur to those skilled in the art. It is, therefore, to be understood that the appended claims are intended to cover all modifications and/or changes as fall within claimed subject matter.

What is claimed is:

1. A method of balancing current in a developer roller, the method comprising:

pulsing voltage to a squeegee roller and a cleaner roller, the pulsed voltage yielding a differential voltage at the developer roller after impression; and pulsing compensating voltage to at least one of the squeegee roller or the cleaner roller to reduce or cancel an accumulated developer current imbalance of the developer roller, wherein the compensating voltage pulses comprise pulses before or after the impression.

2. The method of claim 1, further comprising:

measuring the developer current; and determining a time, a magnitude, or a combination thereof, of the compensating voltage based on the measured developer current.

3. The method of claim 2, further comprising aggregating measured developer current values and basing the compensating voltage on the aggregated measured developer current values.

4. The method of claim 1, wherein the compensating voltage comprises a static magnitude of voltage differential.

5. The method of claim 1, wherein the compensating voltage comprises adjusting a voltage potential at the cleaner roller after the impression.

6. An electrophotography printing device comprising:

a developer roller to attract a charged print fluid responsive to application of an electric field;

a photo imaging plate (PIP) arranged to rotate in contact with the developer roller and attract print fluid from the developer roller;

a cleaner roller arranged to rotate in contact with the developer roller and to remove residual print fluid from the developer roller;

a power supply to set voltage potentials of the developer roller, the PIP, and the cleaner roller; and a controller to transmit signals to the power supply to:

pulse voltage to the cleaner roller and the developer roller to yield a differential voltage at the developer roller after impression; and pulse compensating voltage to the cleaner roller to reduce or cancel an accumulated developer current imbalance of the developer roller based on the differential voltage, wherein the compensating voltage pulses comprise pulses before impression, pulses after impression, or a combination thereof.

7. The device of claim 6, wherein the developer roller comprises a first layer and a second layer, the first and the second layers comprising rubber.

8. The device of claim 7, wherein the first layer comprises an ionic conductor.

9. The device of claim 8, wherein the ionic conductor comprises lithium (Li) salt.

10. A method of transferring print fluid solids comprising conductive particles from a developer roller (DR) to a photo imaging plate (PIP), the method comprising:

forming a first field between the DR and an electrode by setting, using a power supply, a first voltage at the electrode, wherein in response to the formed first field the print fluid is attracted to the DR from a fluid collection part of a developer unit;

forming a second field between a squeegee roller (SQ) and the DR by setting, using the power supply, a second voltage at the SQ, wherein the second field concentrates print fluid solids on the DR;

transferring the print fluid to the PIP based on a third field between the PIP and the DR; and removing residual print fluid from the DR based on a fourth electric field formed between the DR and a cleaner roller (CL);

wherein a developer current is formed at the DR in response to the first field, the second field, the third field, and the fourth field; and wherein the method further comprises transmitting a compensating voltage to the CL to counter the accumulated developer current imbalance at the DR.

11. The method of claim 10, wherein the compensating voltage is based on measurements of a developer current.

12. The method of claim 11, wherein the measurements are determined by sampling developer current at a frequency greater than a frequency of oscillation of the developer current.

13. The method of claim 11, wherein a duration of the compensating voltage is based on the developer current measurements.

14. The method of claim 11, wherein a magnitude of the compensating voltage is based on the developer current measurements.

15. The method of claim 10, wherein transmitting the compensating voltage comprises setting the compensating voltage at the CL subsequent to transfer of the print fluid to the PIP.

* * * * *